US012059728B2

(12) United States Patent
Huang et al.

(10) Patent No.: US 12,059,728 B2
(45) Date of Patent: Aug. 13, 2024

(54) DEFORMATION-DRIVEN SOLID-PHASE EXTRUSION DEVICE AND ONE-STEP ALLOY BAR PREPARATION METHOD BY USING SAME

(71) Applicant: Harbin Institute of Technology, Harbin (CN)

(72) Inventors: Yongxian Huang, Harbin (CN); Yuming Xie, Harbin (CN); Xiangchen Meng, Harbin (CN); Feifan Wang, Harbin (CN); Junchen Li, Harbin (CN); Long Wan, Harbin (CN)

(73) Assignee: Harbin Institute of Technology, Harbin (CN)

( * ) Notice: Subject to any disclaimer, the term of this patent is extended or adjusted under 35 U.S.C. 154(b) by 93 days.

(21) Appl. No.: 17/407,543

(22) Filed: Aug. 20, 2021

(65) Prior Publication Data

US 2023/0053869 A1 Feb. 23, 2023

(51) Int. Cl.
*B22F 3/093* (2006.01)
*B22F 3/00* (2021.01)

(52) U.S. Cl.
CPC ..... *B22F 3/093* (2013.01); *B22F 3/003* (2013.01)

(58) Field of Classification Search
CPC .. B22F 3/093; B22F 3/004; B22F 3/20; B22F 2003/202; B22F 3/204; B22F 5/007; B22F 3/003; B23K 13/00; B23K 11/0013; B23K 20/1215
USPC ..... 419/41, 67
See application file for complete search history.

(56) References Cited

U.S. PATENT DOCUMENTS 5,262,123 A * 11/1993 Thomas ..... C23C 26/02 419/67
2015/0075242 A1* 3/2015 Eller ..... B21C 25/02 72/283

FOREIGN PATENT DOCUMENTS

CN 109623127 A * 4/2019 ..... B23K 20/12
CN 110102867 A 8/2019

OTHER PUBLICATIONS

CN-109623127-A english translation (Year: 2019).*
Bhaduri (Mechanical properties and working of metals and alloys. vol. 264. Singapore: Springer Singapore, 2018.) (Year: 2018).*

* cited by examiner

*Primary Examiner* — Sally A Merkling
*Assistant Examiner* — Ricardo D Morales
(74) *Attorney, Agent, or Firm* — Fox Rothschild LLP

(57) ABSTRACT

A deformation-driven solid-phase extrusion device and a one-step alloy bar preparation method by using the same are provided. The device includes a stir tool, an extrusion container and an ejector rod. The stir tool has an integral structure composed of an upper mounting part and a lower working part and having a hollow channel. The lower working part is disposed in a groove of the extrusion container, and the ejector rod is disposed in the hollow channel of the stir tool. The method includes adding alloy powder to the extrusion container, enabling the stir tool to exert a pressure and revolve at a high speed to cause large plastic deformation of the powder and generate heat by friction and deform among powder and the friction working surface of the working part, sintering the alloy powder and extruding the same through the hollow channel of the stir tool.

9 Claims, 4 Drawing Sheets

DEFORMATION-DRIVEN SOLID-PHASE EXTRUSION DEVICE AND ONE-STEP ALLOY BAR PREPARATION METHOD BY USING SAME

TECHNICAL FIELD

The present disclosure belongs to the technical field of powder metallurgy, and in particular to a deformation-driven solid-phase extrusion device and a one-step alloy bar preparation method by using the same.

BACKGROUND ART

Structural metallic materials play an important role in economic construction. To meet higher requirements on structural materials in the aspects of social development and national security, it is required to break through limitations of traditional materials. Therefore, it is necessary to develop a novel material preparation method. Powder metallurgy, including hot-pressing sintering, hot isostatic pressing, spark plasma sintering, and so on, have been widely used in industries of aerospace, transportation, power electronics and the like. As classical preparation approaches of solid-phase materials, the powder metallurgy have the advantages of excellent performance, energy saving and environmental friendliness, low cost, and so on, as compared with liquid-phase preparation approaches.

However, due to inherent characteristics of the processes, current powder metallurgy techniques have some limitations in physical properties, mechanical properties and processes: (1) The grain microstructure is coarse. The grain size obtained via powder metallurgy is smaller than that from casting, i.e., liquid-phase methods, but still cannot meet the use requirement. Therefore, structural alloy materials prepared by the powder metallurgy are often subjected to cold working or thermal working subsequently to further refine their microstructures and improve the mechanical properties of the materials, such as strength, hardness and plasticity. (2) The microstructure is not dense enough due to porosity. Since the powder metallurgy permit direct sintering of a powder into a bulk structural material, and the pores in the powder are difficult to eliminate thoroughly without external force, thereby having influence on the thermal conductivity, electrical conductivity and mechanical properties of the material. (3) The preparation efficiency is low. Since the powder sintering needs to be performed at an elevated temperature, and both heating and cooling stages take a long time, resulting in reduced preparation efficiency of the powder metallurgy techniques.

In view of the above-mentioned three issues, the depth and scope of use of powder metallurgic techniques will be greatly expanded by developing a technique that allows for preparation of ultrafine-grained and dense microstructures without an external heat source during preparation, breaks through the inherent limitations of the powder metallurgy in preparation of structural alloy materials and improves the strength and abrasive performance of powder metallurgic materials.

SUMMARY

To solve the technical problems of the powder metallurgy in the preparation of the structural alloy material, such as time and energy consumption due to use of an external heat source during preparation, and coarse structure, large porosity and low density of resulting alloy materials, the present disclosure provides a device and method for one-step alloy bar preparation by deformation-driven solid-phase extrusion of a powder with large plastic deformation induced and heat produced by deformation during sintering.

The present disclosure provides a deformation-driven solid-phase extrusion device, which includes a stir tool, an extrusion container and an ejector rod. The stir tool has an integral structure composed of an upper mounting part and a lower working part and having a hollow channel; an anti-drag groove is formed in an outer surface of the lower working part; the lower working part is disposed in a groove of the extrusion container; and the ejector rod is disposed in the hollow channel of the stir tool.

In some embodiments, the upper mounting part and the lower working part may be cylinders.

In some embodiments, the upper mounting part may have a diameter slightly smaller than that of the lower working part.

In some embodiments, a ratio of diameters of the lower working part and the hollow channel may be 2:1 to 10:1.

In some embodiments, a mounting surface may be formed in an outer surface of the upper mounting part.

In some embodiments, a friction working surface in a bottom of the lower working part may be an inner concave ring surface.

In some embodiments, the inner concave ring surface may be sunken inwardly by 5°.

In some embodiments, the diameter of the lower working part may be equal to an inner wall diameter of the extrusion container.

In some embodiments, the stir tool may be made of a steel, a cemented carbide, a tungsten-rhenium alloy or ceramics, with hardness not lower than that of an alloy powder.

In some embodiments, the extrusion container may be made of a magnesium alloy, an aluminum alloy, a zinc alloy, a copper alloy, a titanium alloy or a steel, with principal elements consistent with those of the alloy powder.

In some embodiments, the ejector rod may be made of a steel, a cemented carbide, a tungsten-rhenium alloy or ceramics, with hardness not lower than that of the alloy powder.

In some embodiments, one end of the ejector rod may be an expanded end. The expanded end is used to exert an upsetting pressure, rendering an alloy bar denser and reducing the porosity of the material.

In some embodiments, the expanded end may have a diameter equal to that of the hollow channel.

The device operates according to the following principle: the extrusion container is clamped on a fixture, and the stir tool is clamped on a spindle of a machine with the mounting surface of the upper mounting part being clamped. The ejector rod is arranged in the hollow channel of the stir tool through the spindle of the machine. The stir tool is enabled to rotate at a high speed and exert a pressure under displacement control. The ejector rod exerts the upsetting pressure under the control of the pressure to cause large plastic deformation of the powder and generate heat by friction and deform among powder and the friction working surface of the working part, so that the alloy powder in the extrusion container is sintered and extruded through the hollow channel of the stir tool against the upsetting pressure of the ejector rod. Thus, an ultrafine-grained alloy bar is prepared by one-step.

A one-step alloy bar preparation method by using the above-described deformation-driven solid-phase extrusion device provided in the present disclosure includes the following steps of:

Adding the alloy powder to the extrusion container, setting a rotating speed of the stir tool to a range of 50 rpm to 10000 rpm, a pressing speed of the stir tool to a range of 0.1 mm/min to 10 mm/min and the upsetting pressure of the ejector rod to a range of 5 MPa to 50 MPa, and then carrying out one-step deformation-driven solid-phase extrusion to obtain the alloy bar.

In some embodiments, the alloy powder may be a magnesium alloy powder, an aluminum alloy powder, a zinc copper powder, a copper alloy powder, a titanium alloy powder, or a steel powder.

In some embodiments, the one-step deformation-driven solid-phase extrusion may be carried out in protective gas atmosphere.

In some embodiments, the protective gas may be argon or nitrogen.

Compared with the traditional powder metallurgy, the present disclosure has the following advantages:

1) There is no need for the external heat source. The deformation-driven solid-phase extrusion stir tool comes into direct contact with the powder to cause large plastic deformation of the powder and generate heat by friction and deform among powder and the friction working surface of the working part. Heating and cooling can be completed within several seconds. Thus, a low-temperature sintering method which is low in cost, high in efficiency, excellent in performance, energy-saving and environmentally friendly is realized.

2) Large plastic deformation is induced to help to effectively break an oxide film on the surface of the alloy material during sintering and eliminate pores in the powder. Thus, the powder is directly sintered into bulk material. As a result, the obtained alloy bar may have low porosity of 0.05%, high tensile strength of 375 MPa, and elongation of 15.2%.

3) In the present disclosure, the temperature condition needed in the powder sintering is completely created by heat produced by friction and deform among powder and the friction working surface of the working part. The heat production rates of the two heat production mechanisms are negatively correlated to the flow stress of the material, which allows for negative feedback control of heat output. The temperature condition is strictly maintained in the vicinity of a lower limit of the temperature needed for dynamic recrystallization of the material, thereby preventing grain growth while realizing continuous dynamic recrystallization of structure. As a result, the ultrafine-grained structure can be obtained with an average grain diameter of 1.2 μm.

4) The torque needed during deformation-driven solid-phase extrusion is reduced by means of the anti-drag groove in the lower working part, thereby avoiding torsional fracture of the stir tool.

5) The method and the device provided herein have a wide application range and can be widely used for deformation-driven solid-phase extrusion preparation of most the alloy materials,

DETAILED DESCRIPTION OF THE PREFERRED EMBODIMENTS

Specific Embodiment 1

Figure 1:
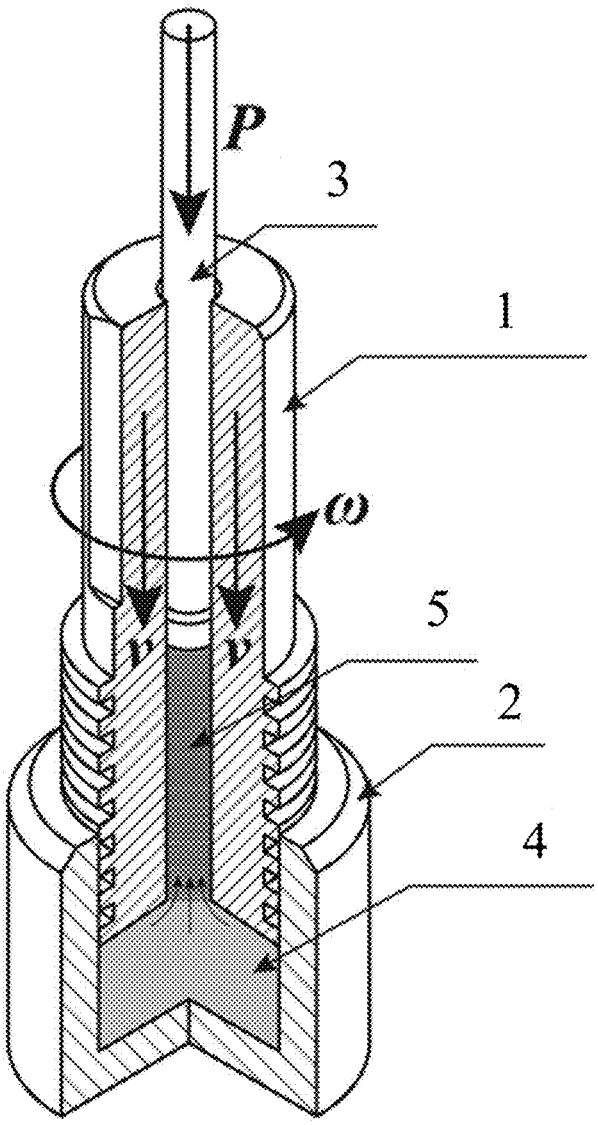
FIG. 1 is a schematic structural diagram of a deformation-driven solid-phase extrusion device according to the present disclosure.
Figure 2:
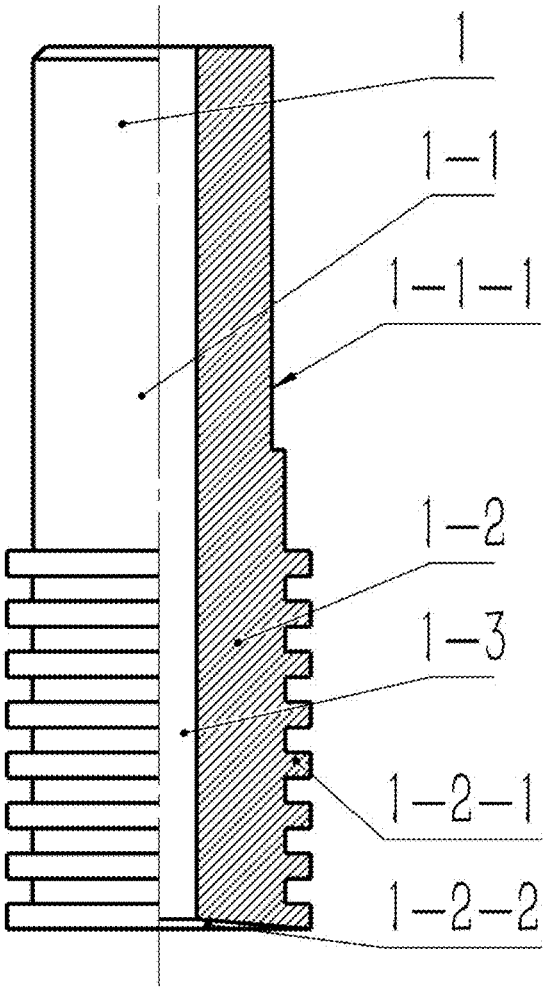
FIG. 2 is a schematic structural diagram of a stir tool according to the present disclosure.
Figure 3:
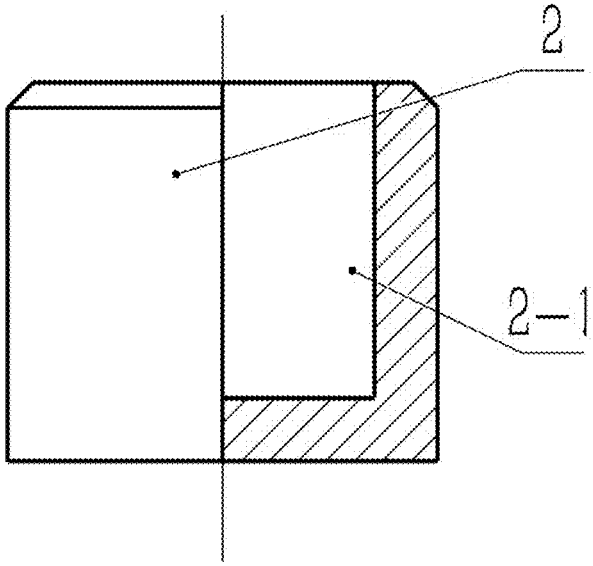
FIG. 3 is a schematic structural diagram of an extrusion container according to the present disclosure.
Figure 4:
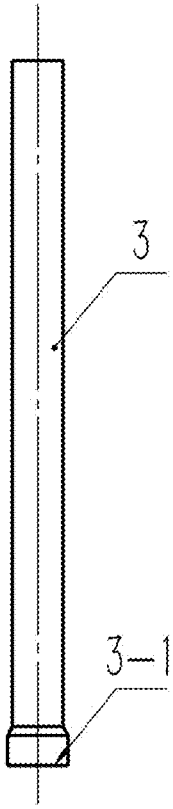
FIG. 4 is a schematic structural diagram of an ejector rod according to the present disclosure.

A deformation-driven solid-phase extrusion device provided in this embodiment includes a stir tool 1, an extrusion container 2 and an ejector rod 3. The stir tool has an integral structure composed of an upper mounting part 1-1 and a lower working part 1-2, and having a hollow channel 1-3. An anti-drag groove 1-2-1 is formed in an outer surface of the lower working part 1-2. The lower working part 1-2 is disposed in a groove 2-1 of the extrusion container 2, and the ejector rod 3 is disposed in the hollow channel 1-3 of the stir tool 1. The upper mounting part 1-1 and the lower working part 1-2 are cylinders. A mounting surface 1-1-1 is formed in an outer surface of the upper mounting part 1-1. A friction working surface 1-2-2 in a bottom of the lower working part 1-2 is an inner concave ring surface. One end of the ejector rod 3 is an expanded end 3-1. As show in FIG. 1, the reference character 4 denotes alloy powder, and the reference character 5 denotes the alloy bar.

The upper mounting part 1-1 has a diameter of 19.9 mm.

The lower working part 1-2 has a diameter of 24 mm.

The hollow channel 1-3 has a diameter of 5 mm.

The inner concave ring surface is sunken inwardly by 5°.

The extrusion container 2 has an inner diameter equal to the diameter of the lower working part 1-2.

The expanded end 3-1 has a diameter equal to the diameter of the hollow channel 1-3.

The stir tool 1 is made of W6Mo5Cr4V2 steel with Vickers microhardness of 850 HV.

The extrusion container 2 is made of 6082-T6 aluminum alloy with Vickers hardness of 103 HV.

The ejector rod 3 is made of W6Mo5Cr4V2 steel with Vickers microhardness of 850 HV.

The device operates according to the following principle: the extrusion container 2 is clamped on a fixture, and the stir tool 1 is clamped on a spindle of a machine with the mounting surface 1-1-1 of the upper mounting part 1-1 being clamped. The ejector rod 3 is arranged in the hollow channel 1-3 of the stir tool 1 through the spindle of the machine. The stir tool 1 is enabled to revolve at a high speed and exert a pressure under displacement control. The ejector rod 3 exerts an upsetting pressure under the control of the pressure to cause large plastic deformation of the powder and generate heat by friction and deform among powder and the friction working surface of the working part, so that the alloy powder in the extrusion container 2 is sintered and extruded through the hollow channel 1-3 of the stir tool 1 against the upsetting pressure of the ejector rod 3. Thus, an ultrafine-grained alloy bar is prepared by one step.

A one-step alloy bar preparation method by using the above-described deformation-driven solid-phase extrusion device provided in this embodiment includes the following steps of: adding the alloy powder 4 to the extrusion container 2, setting a rotating speed of the stir tool 1 to 800 rpm, a pressing speed of the stir tool 1 to 2 mm/min and the upsetting pressure of the ejector rod 3 to 15 MPa, and then carrying out one-step deformation-driven solid-phase extrusion to obtain the alloy bar 5.

The alloy powder is 6082 aluminum alloy powder.

The one-step deformation-driven solid-phase extrusion is carried out in argon atmosphere.

Tests

Tests were conducted on the alloy bar obtained according to the above embodiment with respect to porosity, tensile strength and grain size, and results are as follows:

1. By the method provided in this embodiment, the porosity of the alloy bar was reduced to 0.05%, and the obtained alloy bar 5 has a tensile strength of 375 MPa and elongation of 15.2%.

Figure 5:
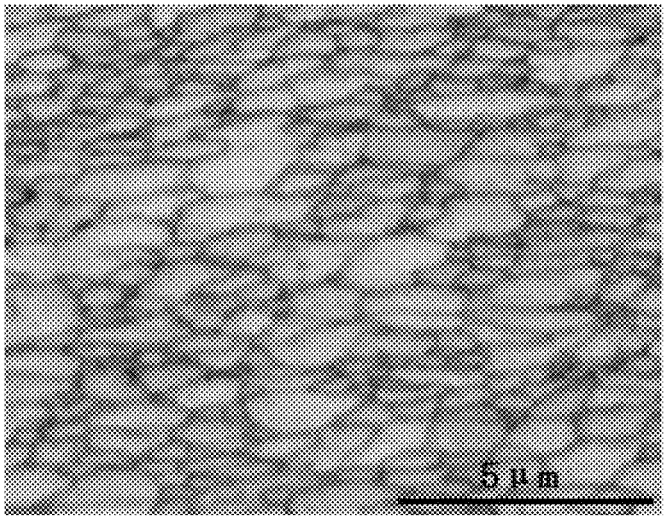
FIG. 5 is an electron back-scattered diffraction (EBSD) image of an alloy bar obtained according to specific embodiment 1 of the present disclosure.

2. FIG. 5 shows the EBSD image of the ultrafine-grained structure of the alloy bar. From FIG. 5, it could be seen that the alloy bar obtained according to this embodiment has an average grain diameter of 1.2 μm.

What is claimed is:

1. A one-step alloy bar preparation method by using a deformation-driven solid-phase extrusion device, the deformation-driven solid-phase extrusion device comprising a stir tool, an extrusion container and an ejector rod, wherein the stir tool has an integral structure composed of an upper mounting part and a lower working part and having a hollow channel; an anti-drag groove is formed in an outer surface of the lower working part; the lower working part is disposed in a groove of the extrusion container; and the ejector rod is disposed in the hollow channel of the stir tool;

the method comprising following steps of:

adding alloy powder to the extrusion container;

setting a rotating speed of the stir tool to a range of 50 rpm to 10000 rpm, setting a pressing speed of the stir tool to a range of 0.1 mm/min to 10 mm/min and an upsetting pressure of the ejector rod to a range of 5 MPa to 50 MPa;

simultaneously performing operations of exerting the upsetting pressure with the range of 5 MPa to 50 MPa on the ejector rod, and enabling the stir tool to revolve at the rotating speed with the range of 50 rpm to 10000 rpm and to be pressed downwards at the pressing speed with the range of 0.1 mm/min to 10 mm/min, so as to sinter the alloy powder in the extrusion container to produce sintered products and extrude the sintered products through the hollow channel of the stir tool against the upsetting pressure on the ejector rod, such that one-step deformation-driven solid-phase extrusion is carried out to obtain the alloy bar.

2. The method according to claim 1, wherein a ratio of diameters of the lower working part and the hollow channel is 2:1 to 10:1.

3. The method according to claim 1, wherein a mounting surface is formed in an outer surface of the upper mounting part.

4. The method according to claim 1, wherein a friction working surface in a bottom of the lower working part is an inner concave ring surface.

5. The method according to claim 4, wherein the inner concave ring surface is sunken inwardly by 5°.

6. The method according to claim 1, wherein the stir tool is made of a steel, a cemented carbide, a tungsten-rhenium alloy or ceramics.

7. The method according to claim 1, wherein the extrusion container is made of a magnesium alloy, an aluminum alloy, a zinc alloy, a copper alloy, a titanium alloy or a steel.

8. The method according to claim 1, wherein the ejector rod is made of a steel, a cemented carbide, a tungsten-rhenium alloy or ceramics.

9. The method according to claim 1, wherein one end of the ejector rod is an expanded end.

* * * * *